United States Patent [19]

Tkac

[11] 4,373,822

[45] Feb. 15, 1983

[54] CLOCK WITH SELECTIVE VISUAL ALARM INDICATORS

[76] Inventor: Frank S. Tkac, 619 Brighton Ave., Pennside, Reading, Pa. 19606

[21] Appl. No.: 207,803

[22] Filed: Nov. 17, 1980

Related U.S. Application Data

[63] Continuation-in-part of Ser. No. 52,908, Jun. 28, 1979, abandoned.

[51] Int. Cl.[3] ..... G04C 21/16

[52] U.S. Cl. ..... 368/256

[58] Field of Search ..... 368/1, 3, 12, 24, 43, 368/67, 71, 72, 227, 256, 239, 82, 261; 340/371, 366 E

[56] References Cited

U.S. PATENT DOCUMENTS

| | | | |
|---|---|---|---|
| 1,441,069 | 6/1923 | Dandy | 368/227 X |
| 2,036,831 | 4/1936 | Salhofer | 368/256 |
| 2,091,205 | 8/1937 | Johnson | 368/256 |
| 2,444,748 | 7/1948 | Parissi | 368/256 |
| 2,526,442 | 10/1950 | Winn | 368/227 |
| 3,616,640 | 11/1971 | Besnicoff | 368/227 |
| 3,727,395 | 4/1973 | Baylor | 368/256 |
| 3,835,640 | 9/1974 | Hughes, Jr. | 368/63 |
| 3,845,614 | 11/1974 | Christ | 58/19 A |
| 4,003,197 | 1/1977 | Haber | 368/67 |
| 4,106,281 | 8/1978 | Freeman | 58/50 R |
| 4,223,801 | 9/1980 | Carlson | 368/10 |
| 4,258,354 | 3/1981 | Carmon et al. | 368/10 |
| 4,274,151 | 6/1981 | Kamiwaki | 368/21 |

*Primary Examiner*—Vit W. Miska

*Attorney, Agent, or Firm*—Alexis Barron

[57] ABSTRACT

A novelty alarm clock that incorporates an illumination system that selectively lights portions of the clock face, at least a portion of the illumination system being governed by the alarm-setting mechanism of the clock which can also include an aural alarm that gives a desired message.

6 Claims, 2 Drawing Figures

CLOCK WITH SELECTIVE VISUAL ALARM INDICATORS

CROSS REFERENCE TO RELATED APPLICATION

This application is a continuation-in-part of my copending application Ser. No. 052,908, filed June 28, 1979, now abandoned.

FIELD OF THE INVENTION

This invention relates to alarm clocks and specifically to such clocks that include novelty features that make the clocks attractive to persons who play particular types of games.

REPORTED DEVELOPMENTS

The common electric alarm clock that has a sixty-cycle synchronous motor, an escapement for controlling the movement of clock hands, an alarm-setting means and an alarm-energizing and shut-off means are, of course, known and have been in wide use for many years. The common type of alarm found in such clocks is an electrically actuated buzzer, the function of which is controlled by the alarm setting and alarm-energizing mechanisms of the clock. For convenience, the alarm-enabling mechanism usually includes an integral shut-off mechanism for stopping the alarm. It is also common, especially in the middle to higher priced clocks, to include a low level illumination system that enables the clock face to be read at close distances in the dark.

Also, alarm clocks have been proposed that turn on a light at a predetermined time (for example, see U.S. Pat. No. 2,036,831 to Salkofer and U.S. Pat. No. 2,444,748 to Parissi) or that simulate certain desired sounds (for example, see U.S. Pat. No. 2,097,818 to Krakowski).

However, such clocks do not incorporate the novelty value that would make them particularly attractive to persons who are aficionados of certain games. In this context, applicant has developed a clock design that is particularly attractive to players of the game of Bingo and, while it is believed that the novelty clock may incorporate features that can be adapted to be attractive to persons following interests in other hobbies or games, the following description will be in terms of a novelty clock especially attractive to Bingo players.

OBJECTS OF THE INVENTION

It is an object of the invention to provide a novelty alarm clock that is especially attractive to players of certain games.

It is also an object of the invention to provide an alarm clock with an illumination system that is at least in part controlled by the alarm setting of the clock.

It is also an object of the invention to provide a novelty alarm clock that provides visual and aural alarm indications.

SUMMARY OF THE INVENTION

These and other objects of the invention are accomplished by incorporating a lighting system in the clock that lights predetermined regions of the clock face. The lighting of at least a portion of the predetermined regions of the clock face is controlled in accordance with the alarm time set by the user. In this manner, the clock provides a visual alarm. Integrated with the visual alarm is an aural alarm that constitutes, preferably, a repetitive predetermined word or sound.

DESCRIPTION OF THE PREFERRED EMBODIMENT

Figure 1:
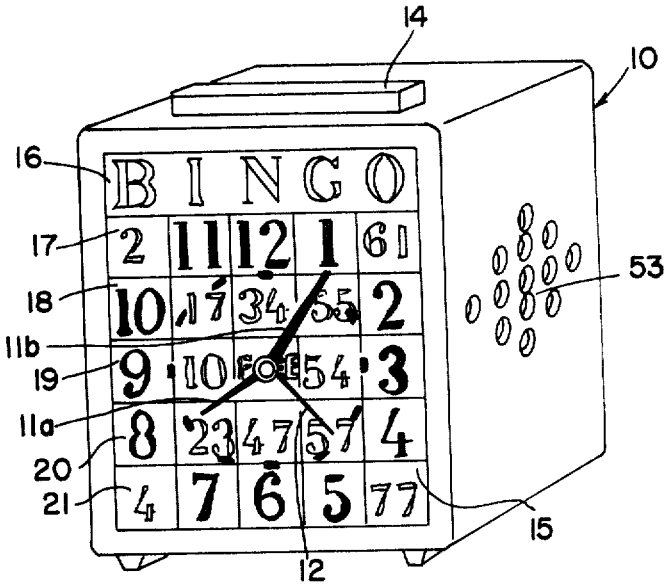
FIG. 1 shows a perspective view of a clock having a face particularly adapted for use with the disclosed invention.
Figure 2:
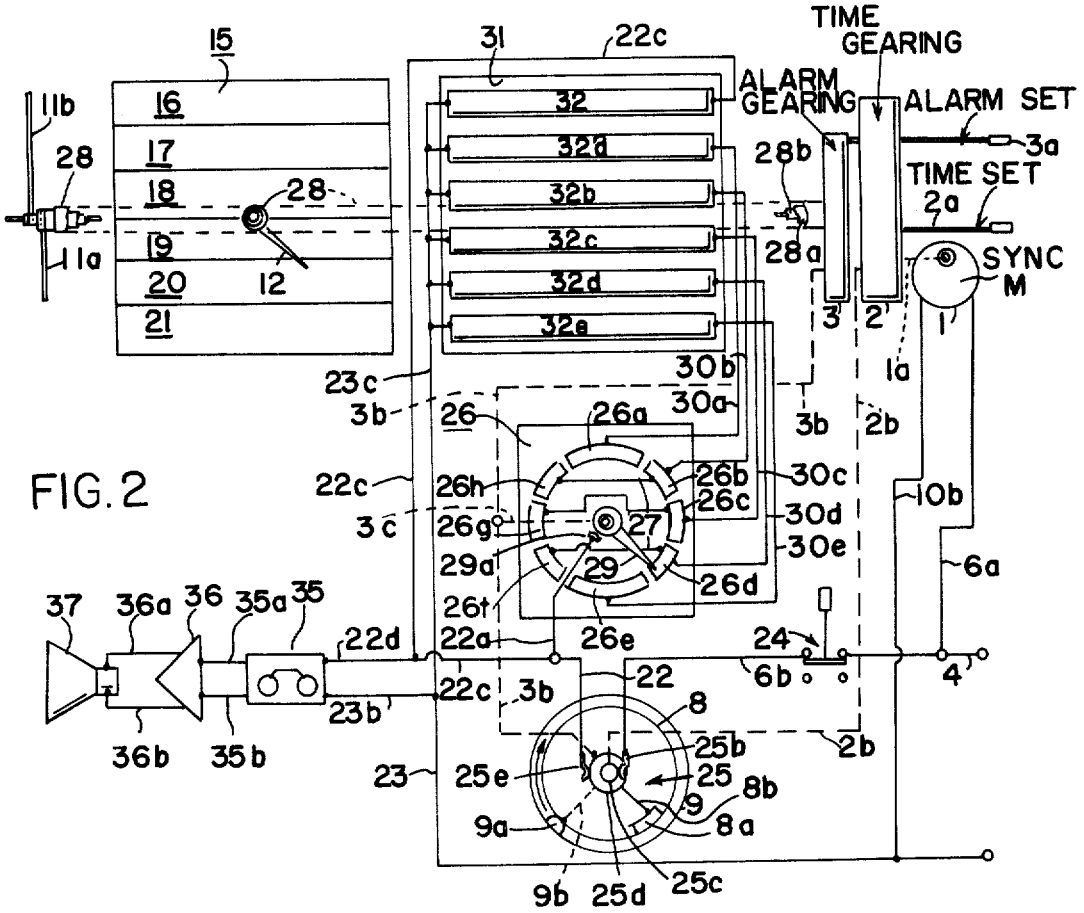
FIG. 2 is a schematic representation of the system for controlling the visual and aural alarm systems to be incorporated into an alarm clock.

Referring to FIGS. 1 and 2, there is shown an alarm clock 10, the major operative portions of which can be derived from a conventional electric motor-driven alarm clock, for example, the type that utilizes a synchronous motor 1, connected, as indicated by dashed line 1*a*, to gearing 2 for maintaining the appropriate time. The time can be set by means of stem 2*a*, which usually protrudes from the back of the clock. Such clocks conventionally include time-indicating hands 11*a* and 11*b* that are movable by the clock gearing 2 through concentric hollow shafts 28*a* and 28*b* over a face 15 that incorporates indicia for indicating the proper time. Such clocks also routinely include an alarm indicator 12 mounted on shaft 28 and capable of being manually set by the user, usually by means of a rotatable stem 3*a* positioned at the back of the clock and connected to suitable gearing 3. The user sets the indicator 12 to the desired alarm time and appropriate mechanism within the clock, indicated by dashed lines 2*b*, correspondingly positions mechanism within switch 25 for allowing the alarm system of the clock to be energized at the time corresponding to that indicated by the alarm hand 12. Conventionally, such clocks include a manually settable means, for example, a rockingly mounted bar 14 or a push-in/pull-out alarm control stem for enabling and disabling the alarm. All of the foregoing is considered to be conventional practice in the manufacture of alarm clocks and it is believed no additional detail as to the basic structure of the clock is necessary.

Referring again to FIG. 1, the face in the preferred embodiment is somewhat different from conventional clocks in that it is divided into a plurality of transversely extending areas 16, 17, 18, 19, 20, and 21. In the preferred example, the area 16 is considered a "common" area and includes a suitable legend, for example, the word "Bingo" as it appears on the face in FIG. 1. As is evident from FIG. 1, the preferred embodiment of the clock face is designed to simulate the conventional bingo card and thus the face includes a plurality of transversely extending number-bearing rows 17, 18, 19, 20 and 21. Also, the face is vertically subdivided into five columns of numbers, each numbered column being aligned with one of the letters of the word "Bingo" that is associated with area 16. It is contemplated that the numerals on the face can be arranged in several different designs or forms. For example, the time indicia can comprise numbers that are positioned to indicate the appropriate time. Another variant would be to use random numbers on the clock face and merely indicate the time by means of dots (as shown) or other suitable indicia. It should further be recognized that the areas 16, 17, 18, 19, 20 and 21 can be arranged in other forms. For example, areas could be arranged in side-by-side vertical rows or perhaps diagonal or concentric arrangements.

An important feature of the alarm system is that it includes means for selectively making parts of the clock face function as a component of the alarm. In this regard, attention is directed to FIG. 2 that schematically shows an arrangement for providing selective illumination to provide such an alarm component.

In the circuitry shown in FIG. 2, terminals 4 and 5 are the connections to the external electric power supply (not shown). Wires 6*a* and 10*b* carry the current between terminals 4 and 5 and synchronous motor 1. Conductor 6*b* carries current from terminal 4 to switch 25 when switch 24 (connected to bar 14 of FIG. 1) is closed, as shown in FIG. 2.

Switch 25 is the means by which the clock energizes the alarm at the time set by the user, provided that the user has closed switch 24. In the arrangement shown, switch 25 consists primarily of two coaxially-mounted disks of different radii. The larger or outer disk 9 is rotated to correspond with the movement of hour hand 11*a* by motor 1 through appropriate gearing 2, as indicated schematically by dotted line 2*b*. Smaller or inner disk 8 is capable of being manually rotated by appropriate gearing 3, as indicated schematically by dotted line 3*b*, as stem 3*a* is rotated to position alarm indicator 12. Accordingly, disk 9 rotates with respect to normally stationary disk 8, disk 8 being moved or rotated only when stem 3*a* is moved to position alarm indicator 12. Each of disks 9 and 8 is provided with a contact point 9*a* and 8*a* respectively which contact points cooperate to trigger the alarm in the following manner. When switch 24 is closed, as shown in the drawing, current flows through conductor 6*b* to brush 25*b*, to shaft/commutator 25*c* and through conductor 9*b* to energize contact 9*a*. As outer disk 9 rotates with contact 9*a* from the position shown and with movement corresponding to that of hour hand 11*a*, it eventually reaches contact 8*a* which is then energized by the current in contact 9*a*. Current flows from contact 8*a* through conductor 8*b*, to shaft/commutator 25*d*, to brush 25*e*, and to conductor 22. The relative sizes of contacts 9*a* and 8*a* determine how long the alarm remains energized if the user does not disengage switch 24. The embodiment of switch 25 is conventional and illustrative only, and it should be understood that the same end can be achieved by other electrical, electromechanical or electronic means.

Current from conductor 22 flows to conductor 22*a* to a suitable distributor system which activates the alarm in the following manner. Electrically conductive wiper arm 29 is energized by current in conductor 22*a* via brush 29*a*. Wiper arm 29 is capable of being rotated by appropriate gearing 3, as indicated schematically by dotted lines 3*b* and 3*c*, as stem 3*a* is rotated to position alarm indicator 12. Wiper arm 29 is associated with contact plate 26 positioned in back of the clock face. Plate 26 has a plurality of contacts 26*a* to 26*h* mounted thereon and positioned to be engaged by wiper arm 29. The contacts engaged by wiper arm 29 depend on the time for which the alarm is set.

Depending upon the design on the clock face, it may be desirable to associate some of contacts 26*a* to 26*h* together so that they will commonly energize a particular area of the alarm indicia on the clock face, as will later be described. Thus, it may be desirable for contact plate 26 to include additional conductors 27 for electrically connecting contacts 26*b* and 26*h*, contacts 26*c* and 26*g*, and contacts 26*d* and 26*f* respectively.

In order to illuminate desired areas of the clock face, the clock is provided with mounting plate 31 disposed behind the clock face and carrying a plurality of lighting means 32*a* to 32*e* and 32 in a predetermined arrangement. In the arrangement illustrated, the lighting means are arranged horizontally so that the rows 16 to 21 are selectively illuminated. However, as previously noted, vertical or other arrangements of the lighting means may also be utilized.

In the preferred arrangement, lighting means 32*a* to 32*e* are disposed behind the rows 17, 18, 19, 20 and 21 respectively so that these rows can be illuminated by their respective lighting means. Lighting means 32 is, in the preferred embodiment, arranged behind the transverse area 16 that carries the Bingo legend. Lighting means 32*a* to 32*e* can comprise any suitable electrical light-emitting device such as incandescent lamps, gaseous discharge lamps or light-emitting diodes. A light source with a visually perceptible blink is preferred. Also, in the preferred embodiment, it is contemplated that mounting plate 31 will be placed behind face 15, with the face being of a transparent or translucent material so that light can shine through it. However, it should be realized that other arrangements for lighting a desired area are contemplated. For example, the numerals in a given row or column can comprise an arrangement of light-emitting diodes that form the desired number or indicia and that are commonly lighted.

Contacts 26*a* to 26*e* are connected by suitable conductors 30*a* to 30*e* respectively to each of lighting means 32*a* to 32*e* so that when current flows through switch 25, as described above, current will be supplied through wiper arm 29 to one of contacts 26*a* to 26*e* and thence through one of associated conductors 30*a* to 30*e* to one of light-emitting devices 32*a* to 32*e* to light a selected area of the clock face.

In addition, it may be desirable to have a common area of the clock, for example, the Bingo panel 16, lighted each time the alarm is actuated. To accomplish this, light-emitting means 32 is connected by conductors 22 and 22*c* to switch 25. The current from all light-emitting means returns to terminal 5 via conductors 23*c* and 23.

Desirably, the alarm system also includes an aural portion that sounds a predetermined alarm. Referring to FIG. 2, this aural portion can comprise a loop-type playback unit 35 on which is recorded the desired predetermined alarm which can, for example, be the word "Bingo". The output of the playback unit 35 is amplified by a conventional amplifier 36 to which it is supplied by conductors 35*a* and 35*b* and which drives the speaker 37 through conductors 36*a* and 36*b*. The speaker 37 can be positioned adjacent apertures 53 in the housing of clock 10 or at any other convenient location that allows transmission of the output of the speaker. The aural portion of the alarm system can be connected directly to the output side of switch 25 via conductors 22, 22*c* and 22*d* so that the aural alarm is activated at the same time as the visual portion of the alarm system. The current returns to terminal 5 from the aural alarm through conductors 23*a* and 23.

Other arrangements for providing a visual alarm to selected portions of the clock face are also contemplated. For example, a single light source can be placed behind a transparent or translucent face and a masking element, having an opening corresponding to the position of the alarm indicator, would result in the desired effect.

Thus, it can be seen that an alarm clock in the contemplation of the invention yields a novel combination of visual and aural alarms that can be integrated with a particular theme for the clock that is attractive to users.

I claim:

1. In an electrical alarm clock, a face, time-indicating means associated with the face, an alarm, control means for manually pre-setting the time at which the alarm is activated, alarm-indicator means for showing the time at which the alarm is to be activated, a plurality of independently activated visual signals, each capable of providing at the time of the activation of the alarm a visual effect on a different portion of the face, a plurality of independently activated signal devices associated respectively with said visual signals for the activation thereof for providing a visual effect on only a portion of the face, and means responsive to said control means for selectively setting the time at which the signal device is activated for activating that visual signal which provides a visual effect on that portion of the face associated with the time at which the alarm is activated.

2. The combination of claim 1, further including at least one additional visual signal device, said additional visual signal device being activated at the same time that any one of said individual signal devices is selectively activated.

3. The combination of claim 2, wherein said additional visual signal device is outside the time-indicating areas of said face.

4. The combination of claim 1 wherein said face is transparent or translucent and said individual signal devices comprise lighting means mounted behind said face.

5. The combination of claim 1, wherein said face is transparent or translucent and said individual signal devices and said additional visual signal device comprise lighting means mounted behind said face.

6. The combination of claim 1 or 2, wherein said alarm comprises means for audibly reproducing a recorded verbal announcement.

* * * * *